US011217181B2

(12) United States Patent
Luan et al.

(10) Patent No.: US 11,217,181 B2
(45) Date of Patent: Jan. 4, 2022

(54) PIXEL COMPENSATION CIRCUIT, METHOD FOR DRIVING THE SAME, AND DISPLAY APPARATUS

(71) Applicants: BOE TECHNOLOGY GROUP CO., LTD., Beijing (CN); HEFEI XINSHENG OPTOELECTRONICS TECHNOLOGY CO., LTD., Anhui (CN)

(72) Inventors: Mengyu Luan, Beijing (CN); Xuehuan Feng, Beijing (CN); Xinfeng Wu, Beijing (CN); Youyuan Hu, Beijing (CN); Fei Li, Beijing (CN); Xinzhu Wang, Beijing (CN); Huihui Li, Beijing (CN); Qi Hu, Beijing (CN)

(73) Assignees: BOE TECHNOLOGY GROUP CO., LTD., Beijing (CN); HEFEI XINSHENG OPTOELECTRONICS TECHNOLOGY CO., LTD., Anhui (CN)

( * ) Notice: Subject to any disclaimer, the term of this patent is extended or adjusted under 35 U.S.C. 154(b) by 811 days.

(21) Appl. No.: 16/068,489

(22) PCT Filed: Nov. 21, 2017

(86) PCT No.: PCT/CN2017/112131
§ 371 (c)(1),
(2) Date: Jul. 6, 2018

(87) PCT Pub. No.: WO2018/214428
PCT Pub. Date: Nov. 29, 2018

(65) Prior Publication Data

US 2021/0210025 A1 Jul. 8, 2021

(30) Foreign Application Priority Data

May 23, 2017 (CN) ..... 201710369037.5

(51) Int. Cl.
*G09G 3/3291* (2016.01)
*G09G 3/3258* (2016.01)

(52) U.S. Cl.
CPC ..... *G09G 3/3291* (2013.01); *G09G 3/3258* (2013.01); *G09G 2320/045* (2013.01)

(58) Field of Classification Search
CPC .. G09G 3/3233; G09G 3/3258; G09G 3/3208; G09G 3/3241; G09G 2300/0819;
(Continued)

(56) References Cited

U.S. PATENT DOCUMENTS

2003/0209989 A1 11/2003 Anzai et al.
2004/0041525 A1* 3/2004 Park ..... G09G 3/3241 315/169.3

(Continued)

FOREIGN PATENT DOCUMENTS

CN 1479270 A 3/2004
CN 1499471 A 5/2004

(Continued)

OTHER PUBLICATIONS

"TS5A3157 10-Ω SPDT Analog Switch", May 2015, Texas Instruments (Year: 2015).*
International Search Report and English translation of Box V of the Written Opinion dated Feb. 22, 2018, received tor corresponding Chinese Application No. PCT/CN2017/112131.

*Primary Examiner* — Dong Hui Liang
(74) *Attorney, Agent, or Firm* — Kinney & Lange, P.A.

(57) ABSTRACT

The present application provides a pixel compensation circuit, a method for driving the same, and a display apparatus. The pixel compensation circuit includes a light emitting element, a current control sub-circuit and a reverse bias sub-circuit. The current control sub-circuit is coupled to a first terminal of the light emitting element and is configured to control current flowing between a first terminal and a second terminal of the light emitting element. The reverse
(Continued)

bias sub-circuit is coupled to a first control signal line and a second terminal of the light emitting element respectively. The reverse bias sub-circuit is configured to set the second terminal of the light emitting element to be at a first bias voltage under the control of a signal on the first control signal line, so that the light emitting element is maintained in a reverse bias state.

10 Claims, 6 Drawing Sheets

(58) Field of Classification Search
CPC ... G09G 2300/0842; G09G 2300/0861; G09G 2320/043; G09G 2320/045; G09G 2320/0223; G09G 2360/145; G06G 2310/0262; G06G 2310/0256
See application file for complete search history.

(56) References Cited

U.S. PATENT DOCUMENTS

| | | | | |
|---|---|---|---|---|
| 2014/0132162 | A1* | 5/2014 | Kim | G09G 3/3266 315/161 |
| 2016/0267843 | A1* | 9/2016 | Wang | G09G 3/3258 |

FOREIGN PATENT DOCUMENTS

| | | | |
|---|---|---|---|
| CN | 102222468 | A | 10/2011 |
| CN | 102930820 | A | 2/2013 |
| CN | 103500556 | A | 1/2014 |
| CN | 103886838 | A | 6/2014 |
| CN | 104217674 | A | 12/2014 |
| CN | 104658483 | A | 5/2015 |
| CN | 105427806 | A | 3/2016 |
| CN | 106940979 | A | 7/2017 |
| EP | 1418566 | A2 | 5/2004 |

* cited by examiner

PIXEL COMPENSATION CIRCUIT, METHOD FOR DRIVING THE SAME, AND DISPLAY APPARATUS

CROSS-REFERENCE TO RELATED APPLICATION(S)

This application is the national phase of PCT Application No. PCT/CN2017/112131, filed on Nov. 21, 2017, which in turn claims priority to the Chinese Patent Application No. 201710369037.5, filed on May 23, 2017, which is incorporated herein by reference in its entirety.

TECHNICAL FIELD

The present application relates to the field of display, and more particularly, to a pixel compensation circuit, a method for driving the same, and a display apparatus.

BACKGROUND

In a display apparatus such as an Organic Light Emitting Diode (OLED), a driving transistor for controlling light emitting current of the OLED has a problem of a drift of a threshold voltage. Brightness uniformity of the entire display screen can be improved through compensation.

SUMMARY

The present application provides a pixel compensation circuit, a method for driving the same, and a display apparatus.

According to a first aspect of the present application, there is provided a pixel compensation circuit, comprising:

a light emitting element;

a current control sub-circuit electrically coupled to a first terminal of the light emitting element and configured to control magnitude of current flowing through the light emitting element; and a reverse bias sub-circuit electrically coupled to a first control signal line for providing a first control signal and a second terminal of the light emitting element respectively;

wherein the reverse bias sub-circuit is configured to set the second terminal of the light emitting element to be at a first bias voltage under the control of the first control signal, so that the light emitting element is maintained in a reverse bias state.

In an example, the reverse bias sub-circuit comprises a first transistor, a second transistor, a third transistor and a fourth transistor, wherein the first transistor has a gate electrode electrically coupled to the first control signal line, a first electrode electrically coupled to a first bias voltage line for providing the first bias voltage, and a second electrode electrically coupled to the second terminal of the light emitting device;

the second transistor has a gate electrode electrically coupled to a first node, a first electrode electrically coupled to the second terminal of the light emitting device, and a second electrode electrically coupled to a second bias voltage line for providing a second bias voltage, wherein the first bias voltage and the second bias voltage are respective ones of a gate-on voltage and a gate-off voltage;

the third transistor has a gate electrode electrically coupled to the first control signal line, a first electrode electrically coupled to the first node, and a second electrode electrically coupled to one of the first bias voltage line and the second bias voltage line which provides the gate-off voltage; and the fourth transistor has a gate electrode and a first electrode electrically coupled to one of the first bias voltage line and the second bias voltage line which provides the gate-on voltage, and a second electrode electrically coupled to the first node;

wherein the third transistor and the fourth transistor are configured to set the first node to be at the gate-off voltage when the first control signal is the gate-on voltage.

In an example, the pixel compensation circuit further comprises a first capacitor, wherein the reverse bias sub-circuit is further electrically coupled to a first terminal of the first capacitor, and is further configured to set the first terminal of the first capacitor to be at a third bias voltage when the first control signal is the gate-off voltage.

In an example, the reverse bias sub-circuit further comprises a fifth transistor having a gate electrode electrically coupled to the first node, a first electrode electrically coupled to the first terminal of the first capacitor, and a second electrode electrically coupled to the second bias voltage line.

In an example, the reverse bias sub-circuit further comprises a fifth transistor, a sixth transistor, and a seventh transistor; wherein the fifth transistor has a gate electrode electrically coupled to a second node, a first electrode electrically coupled to the first terminal of the first capacitor, and a second electrode electrically coupled to the second bias voltage line; the sixth transistor has a gate electrode electrically coupled to the first control signal line, a first electrode electrically coupled to the second node, and a second electrode electrically coupled to one of the first bias voltage line and the second bias voltage line which provides the gate-off voltage; and the seventh transistor has a gate electrode and a first electrode electrically coupled to one of the first bias voltage line and the second bias voltage line which provides the gate-on voltage, and a second electrode electrically coupled to the second node; wherein the sixth transistor and the seventh transistor are configured to enable the second node to be set at the gate-off voltage when the first control signal is the gate-on voltage.

In an example, the current control sub-circuit comprises a driving transistor having a gate electrode coupled to the second terminal of the first capacitor; and the pixel compensation circuit further comprises a data writing sub-circuit electrically coupled to a second control signal line for providing a second control signal, a data line, and the driving transistor, and configured to turn on a connection between the gate electrode and a source electrode of the driving transistor and a connection between the data line and a drain electrode of the driving transistor under the control of the second control signal.

In an example, the pixel compensation circuit further comprises an initialization sub-circuit electrically coupled to a third control signal line for providing a third control signal, the first control signal line and the first terminal and the second terminal of the first capacitor, and configured to set the second terminal of the first capacitor to be at a first initialization voltage under the control of the third control signal, and set the first terminal of the first capacitor to be at a second initialization voltage under the control of the first control signal.

In an example, the pixel compensation circuit further comprises a light emitting control sub-circuit coupled to a fourth control signal line for providing a fourth control signal and the source electrode of the driving transistor respectively, and configured to transfer the first bias voltage to the source electrode of the driving transistor under the control of the fourth control signal.

In an example, the data writing sub-circuit comprises an eighth transistor and a ninth transistor, the initialization sub-circuit comprises a tenth transistor and an eleventh transistor, and the light emitting control sub-circuit comprises a twelfth transistor; wherein in the data writing sub-circuit, the eighth transistor has a gate electrode electrically coupled to the second control signal line, a first electrode electrically coupled to the data line, and a second electrode electrically coupled to the drain electrode of the driving transistor, and the nine transistor has a gate electrode electrically coupled to the second control signal line, a first electrode electrically coupled to the gate electrode of the driving transistor, and a second electrode electrically coupled to the drain electrode of the driving transistor;

In the initialization sub-circuit, the tenth transistor has a gate electrode electrically coupled to the first control signal line, a first electrode electrically coupled to a first reference voltage line for providing the first initialization voltage, and a second electrode electrically coupled to the first terminal of the first capacitor, and the eleventh transistor has a gate electrode electrically coupled to the third control signal line, a first electrode electrically coupled to a second reference voltage line for providing the second initialization voltage or a first bias voltage line for providing the first bias voltage, and a second electrode electrically coupled to the second terminal of the first capacitor; and in the light emitting control sub-circuit, the twelfth transistor has a gate electrode electrically coupled to the fourth control signal line, a first electrode electrically coupled to the first bias voltage line for providing the first bias voltage, and a second electrode electrically coupled to the drain electrode of the driving transistor.

According to a second aspect of the present application, there is further provided a method for driving the pixel compensation circuit according to any of the embodiments of the present application, comprising:

maintaining, by the reverse bias sub-circuit, the light emitting element in a reverse bias state under the control of the first control signal in a time period of each display period other than a time period in which the light emitting element emits light.

According to a third aspect of the present application, there is further provided a display apparatus, comprising the pixel compensation circuit according to any of the embodiments of the present application.

BRIEF DESCRIPTION OF THE DRAWINGS

In order to more clearly explain the technical solutions in the embodiments of the present application, the accompanying drawings used in the description of the embodiments will be briefly described below. Obviously, the accompanying drawings in the following description are merely some embodiments of the present application. Reasonable variations of these accompanying drawings are also included in the scope of the present application. In the accompanying drawings.

DETAILED DESCRIPTION

In order to make the purposes, technical solutions, and advantages of the present application more clear, the embodiments of the present application are further described in detail below with reference to the accompanying drawings. Obviously, the described embodiments are only a part but not all of the embodiments of the present application. All other embodiments obtained by those of ordinary skill in the art based on the described embodiments of the present application without creative efforts shall fall within the protection scope of the present application.

Unless otherwise defined, technical terms or scientific terms used in the present application should be interpreted in the ordinary sense for those of ordinary skill in the art to which the present application belongs. The words such as "first," "second," etc. used in the present application do not mean any order, quantity or importance, but merely serve to distinguish different constituent parts. The word such as "including" etc. means that an element or item preceding the word covers elements or items which appear after the word and their equivalents, but does not exclude other elements or items. The word "coupled" or "coupling" etc. is not limited to physical or mechanical connections but may comprise electrical connections, which may be direct connections or indirect connections.

Brightness uniformity of the entire display screen can be improved through external compensation or internal compensation.

In the internal compensation method, it should prevent the voltage across the OLED from exceeding the light-on voltage thereof as much as possible in the compensation phase. However, this may limit the voltage provided to the pixel compensation circuit, thereby limiting the available compensation range of the threshold voltage for the pixel compensation circuit. As a result, the threshold voltage cannot be completely compensated when the threshold voltage exceeds the available compensation range, which influences the display uniformity among different pixels.

Figure 1:
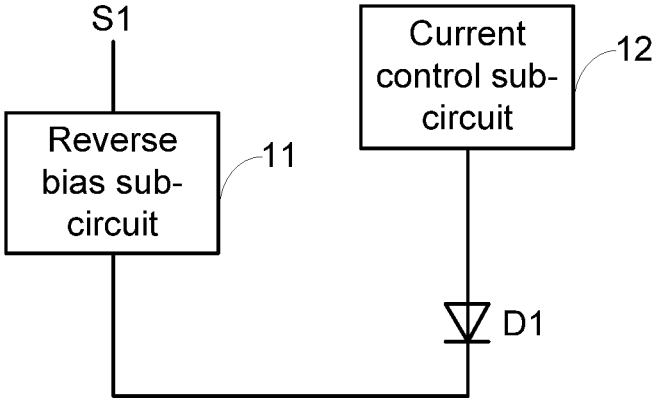
FIG. 1 is a structural block diagram of a pixel compensation circuit according to an embodiment of the present application.

FIG. 1 is a structural block diagram of a pixel compensation circuit according to an embodiment of the present application. As shown in FIG. 1, the pixel compensation circuit according to the embodiment of the present application may comprise a light emitting element D1, a reverse bias sub-circuit 11 and a current control sub-circuit 12. The current control sub-circuit 12 is coupled to a first terminal (an upper terminal in FIG. 1) of the light emitting element D1 and is configured to control current flowing through the light emitting element D1. The reverse bias sub-circuit 11 is coupled to a first control signal line for providing a first control signal S1 and a second terminal of the light emitting element D1, respectively. In the present embodiment, the reverse bias sub-circuit 11 is configured to set the second terminal of the light emitting element D1 to be at a preset first bias voltage under the control of the first control signal S1, so that the light emitting element D1 is maintained in a reverse bias state. For example, the light emitting element D1 may be an organic light emitting diode. For the convenience of description, the description below is made by taking the light emitting element being an organic light emitting diode as an example. It can be understood by those skilled in the art that the "reverse bias state" of the light emitting element refers to an off state in which a positive electrode of a light emitting diode of the light emitting element is at a low potential and a negative electrode thereof is at a high potential. At this time, almost no current flows through the light emitting diode.

In an example, when a power supply voltage for providing driving current to the organic light emitting diode D1 at the first terminal of the organic light emitting diode D1 is less than or equal to the first bias voltage, and thereby the second terminal of the organic light emitting diode D1 is set to be at the first bias voltage, regardless of amplitude of the voltage applied to the pixel compensation circuit, the organic light emitting diode D1 is always in the reverse bias state without emitting light. It can be understood that the a specific implementation of setting the second terminal of the organic light emitting diode to be at the preset first bias voltage so that the organic light emitting diode is maintained in the reverse bias state may not be limited thereto.

Based on the configuration of the reverse bias sub-circuit, the embodiment of the present application may control the reverse bias sub-circuit through the first control signal line so that the light emitting element is maintained in the reverse bias state in the non-light emitting phase. Thus, the voltage provided to the pixel compensation circuit is not limited by the light-on voltage, and thereby the compensation range of the threshold voltage is not limited. The embodiment of the present application may achieve a larger compensation range of the threshold voltage and facilitate improving display uniformity.

Figure 2:
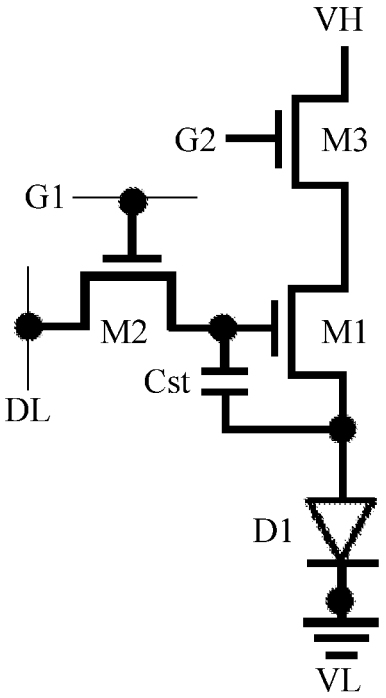
FIG. 2 is a circuit structural diagram of a pixel compensation circuit according to a comparative example of the present application.

A specific reason why the available compensation range of the threshold voltage is limited will be briefly described below. As shown in FIG. 2, an exemplary pixel compensation circuit comprises an organic light emitting diode D1, a storage capacitor Cst, and three transistors M1, M2, and M3. The transistor M2 is controlled by a signal G1, the transistor M3 is controlled by a signal G2, a data line DL for providing a display data signal is coupled to a gate electrode of the driving transistor M1 through a first electrode and a second electrode of the transistor M2, and a high-level voltage line VH is coupled to a source electrode of the driving transistor M1 through a first electrode and a second electrode of the transistor M3. The storage capacitor Cst is provided between the gate electrode and a drain electrode of the driving transistor M1, the source electrode of the driving transistor M1 is coupled to the first terminal of the organic light emitting diode D1, and the second terminal of the organic light emitting diode D1 is coupled to a low-level voltage line VL. It should be illustrated that the transistors M2 and M3 are used as switch transistors, the first electrode and the second electrode are respective ones of a source electrode and a drain electrode of the transistor, and connection relationships for the source electrode and the drain electrode of the transistor may be set respectively depending on a specific type of the transistor, so as to be matched with a direction of current flowing through the transistor. When the transistor has a source-drain symmetrical structure, the source electrode and the drain electrode may be considered as two electrodes which are not differentiated.

As shown in FIG. 2, an operation flow of the pixel compensation circuit in each period may comprise the following phases. In a capacitance resetting phase, the signal G1 controls the transistor M2 to be turned on, the signal G2 controls the transistor M3 to be turned on, and the high-level voltage line VH outputs a low-level voltage in this phase, so that one terminal of the storage capacitor is set to be at a reference voltage by the data line DL and the other terminal of the storage capacitor is set to be at the low-level voltage. In a subsequent threshold voltage detection phase, the high-level voltage line VH is restored to a high-level voltage, so that the storage capacitor Cst is continuously charged until the transistor M1 is turned off. At this time, a voltage at the drain electrode of the transistor M1 is equal to the reference voltage minus a threshold voltage of the transistor M1. In a subsequent data voltage writing phase, the signal G1 controls the transistor M2 to be turned on, the signal G2 controls the transistor M3 to be turned off, and the data line DL writes a data voltage into the gate electrode of the transistor M1 through the first electrode and the second electrode of the transistor M2. The voltage at the drain electrode of the transistor M1 jumps due to charge retention of the storage capacitor Cst. At this time, a voltage difference between the gate electrode and the drain electrode of the transistor M1 is equal to a sum of a value related to the data voltage and the reference voltage and the threshold voltage of the transistor M1. In a subsequent compensation light emitting phase, the signal G1 controls the transistor M2 to be turned off, and the signal G2 controls the transistor M3 to be turned on, so that current flowing through the source electrode and the drain electrode of the transistor M1 is independent of the threshold voltage of the transistor M1, and thereby compensation of the threshold voltage is realized.

However, in the above operation flow, it is required that the organic light emitting diode D1 does not emit light in the capacitance resetting phase, the threshold voltage detection phase, and the data voltage writing phase. On the one hand, detection of the threshold voltage can be realized only when the reference voltage is greater than the threshold voltage of the transistor M1 in the threshold voltage detection phase. On the other hand, in this phase, the organic light emitting diode D1 does not emit light only when a voltage at the first terminal of the organic light emitting diode D1 (up to the reference voltage minus the threshold voltage of the transistor M1) is less than the light-on voltage of the light emitting diode D1. In consideration of the above two aspects, the reference voltage needs to be greater than the preset voltage and less than a sum of the light-on voltage and the threshold voltage, that is, a selectable voltage range of the reference voltage should be equal to the light-on voltage. Therefore, in a case of a given reference voltage, an available maximum compensation value of the threshold voltage is equal to the reference voltage, and an available minimum compensation value of the threshold voltage is equal to the reference voltage minus the light-on voltage. For example, the light-on voltage of the organic light emitting diode D1 is 5V. When the reference voltage is equal to −1V, the available compensation range of the threshold voltage is from −6V to −1V; when the reference voltage is equal to 0V, the available compensation range of the threshold voltage is from −5V to 0V; when the reference voltage is equal to 1V, the available compensation range of the threshold voltage is from −4V to 1V; when the reference voltage is equal to 2V, the available compensation range of the threshold voltage is from −3V to 2V; when the reference voltage is equal to 3V, the available compensation range of the threshold voltage is from −2V to 3V; and when the reference voltage is equal to 4V, the available compensation range of the threshold voltage is from −V to 4V, and so on.

When the threshold voltage of the driving transistor M1 exceeds the available compensation range of the threshold voltage, the practical compensation value in the compensation light emitting phase may only be a boundary value of the available compensation range of the threshold voltage, which may result in incomplete compensation. In order to avoid a situation in which there is any pixel which is incompletely compensated, only a value most widely suitable for all pixels may generally be selected as the reference voltage provided on the display apparatus, such as 2V in the above example, to cover most situations in which the threshold voltage is between −2V and 3V. However, once threshold voltages of some pixels are shifted out of the available compensation range due to factors such as the use of the display apparatus for a long time, the display apparatus may suffer from incomplete compensation. Even if the reference voltage is re-adjusted to cover values of these threshold voltages beyond the original range, there may also be a situation in which other pixels suffer from incomplete compensation. Therefore, it is difficult to repair the display abnormality.

According to the embodiment of the present application, the reverse bias sub-circuit described above is provided, to set the second terminal of the organic light emitting diode D1 to be at the first bias voltage in the capacitance resetting phase, the threshold voltage detection phase, and the data voltage writing phase by controlling the first control signal, so that the organic light emitting diode is maintained in the reverse bias state. Therefore, the set range of the reference voltage is not limited by the light-on voltage of the organic light emitting diode, and thereby the available compensation range of the threshold voltage is also not limited. Therefore, the technical solutions of the embodiments of the present application can achieve a larger available compensation range of the threshold voltage for the pixel compensation circuit and facilitates improving the display uniformity of the display apparatus.

Figure 3:
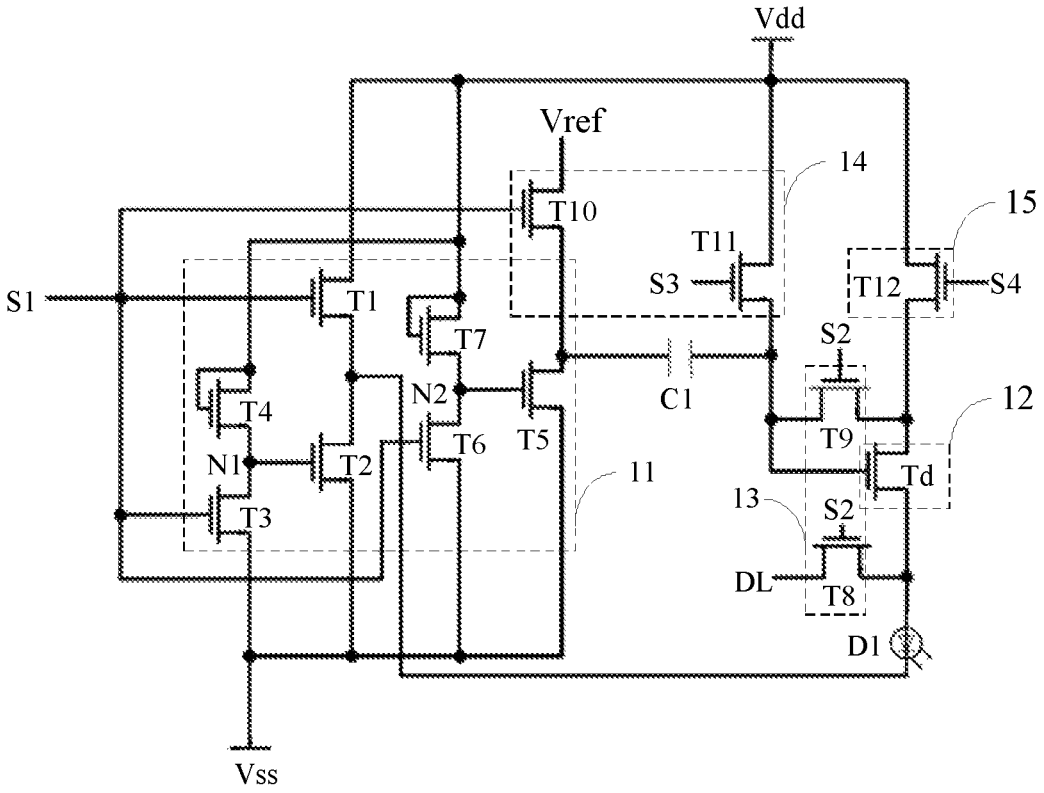
FIG. 3 is a circuit structural diagram of a pixel compensation circuit according to an embodiment of the present application.

FIG. 3 is a circuit structural diagram of a pixel compensation circuit according to an embodiment of the present application. As shown in FIG. 3, the pixel compensation circuit according to the present embodiment may comprise a reverse bias sub-circuit 11, a current control sub-circuit 12, a data writing sub-circuit 13, an initialization sub-circuit 14, a light emitting control sub-circuit 15 and a first capacitor C1. Optional circuit implementations of various sub-circuits will be set forth by taking a circuit structure including transistors which are all N-type transistors as an example. Of course, all the switch transistors included may also be P-type transistors. A structure and a function of each sub-circuit will be firstly described below, and then an operation principle of the pixel compensation circuit will be described in conjunction with a circuit operation timing.

The reverse bias sub-circuit 11 is coupled to the first control signal line S1, a first terminal of the first capacitor C1 and a second terminal of the organic light emitting diode D1 respectively. The reverse bias sub-circuit 11 is configured to set the second terminal of the organic light emitting diode D1 to be at a preset first bias voltage under the control of the first control signal S1, so that the organic light emitting diode is maintained in a reverse bias state, and to set the first terminal of the first capacitor C1 to be at a third preset bias voltage when the first control signal S1 is a gate-off voltage. For example, the second bias voltage is a low-level voltage in the present embodiment. How to set the third bias voltage will be specifically described below in conjunction with the operation principle of the pixel compensation circuit. As all the transistors in the example are N-type transistors, the term "gate-off voltage" refers to a low-level voltage at which the N-type transistor is turned off. On the contrary, a gate-on voltage refers to a high-level voltage at which the N-type transistor is turned on. Of course, depending on a type of the transistor selected, the gate-on voltage and the gate-off voltage may be changed. For example, for a situation in which all the transistors are P-type transistors, the gate-on voltage and gate-off voltage are a low-level voltage and a high-level voltage respectively.

As shown in FIG. 3, the reverse bias sub-circuit 11 may comprise a first transistor T1, a second transistor T2, a third transistor T3 and a fourth transistor T4. The first transistor T1 has a gate electrode coupled to the first control signal line for providing a first control signal, a first electrode coupled to a first bias voltage line for providing the first bias voltage, and a second electrode coupled to the second terminal of the organic light emitting diode. The second transistor T2 has a gate electrode coupled to a first node N1, a first electrode coupled to the second terminal of the organic light emitting diode, and a second electrode coupled to a second bias voltage line for providing a second bias voltage. The first bias voltage and the second bias voltage are respective ones of the gate-on voltage and the gate-off voltage. In the present embodiment, the first bias voltage is a high-level voltage at which the gate electrode is turned on, and the second bias voltage is a low-level voltage at which the gate electrode is turned off. The third transistor has a gate electrode coupled to the first control signal line, a first electrode coupled to the first node, and a second electrode coupled to one of the first bias voltage line and the second bias voltage line which provides the gate-off voltage, for example, the second bias voltage line in the present embodiment. The fourth transistor has a gate electrode and a first electrode coupled to one of the first bias voltage line and the second bias voltage line which provides the gate-on voltage, for example, the first bias voltage line in the present embodiment, and a second electrode coupled to the first node. The third transistor and the fourth transistor are configured to enable the first node to be at the gate-off voltage when the first control signal is the gate-on voltage. For example, a source-drain resistance of the third transistor may be set to be less than that of the fourth transistor.

Based on the above structure, when the first control signal is the gate-on voltage, the first transistor, the third transistor, and the fourth transistor are all turned on, so that the first node N1 is at the gate-off voltage. Thereby, the second transistor is turned off, so that the second terminal of the organic light emitting diode is set to be at the first bias voltage. The above process may also be achieved when the first to fourth transistors are all P-type transistors. Compared with a circuit structure including not only N-type transistors but also P-type transistors, an implementation of the reverse bias sub-circuit using four transistors which are all P-type transistors or N-type transistors can simplify the production process.

In addition, as shown in FIG. 3, the reverse bias sub-circuit 11 may further comprise a fifth transistor, a sixth transistor, and a seventh transistor. The fifth transistor has a gate electrode coupled to a second node N2, a first electrode coupled to the first terminal of the first capacitor, and a second electrode coupled to the second bias voltage line. The sixth transistor has a gate electrode coupled to the first control signal line, a first electrode coupled to the second node N2, and a second electrode coupled to one of the first bias voltage line and the second bias voltage line which provides the gate-off voltage, for example, the second bias voltage line in the present embodiment. The seventh transistor has a gate electrode and a first electrode coupled to one of the first bias voltage line and the second bias voltage line which provides the gate-on voltage, for example, the first bias voltage line in the present embodiment, and a second electrode coupled to the second node. The sixth transistor and the seventh transistor are configured to enable the second node to be set at the gate-off voltage in response to the gate-on voltage on the first control signal line, for example, a source-drain resistance of the sixth transistor may be set to be less than that of the seventh transistor. Based on the above structure, in response to the gate-off voltage on the first control signal line, the sixth transistor is turned off and the seventh transistor is turned on, so that the second node is at the gate-on voltage. Thereby, the fifth transistor is turned on, so that the first terminal of the first capacitor is set to be at a low-level voltage provided by the second bias voltage line. The above process may also be achieved when the fifth to seventh transistors are all P-type transistors. The reverse bias sub-circuit may be realized by the three transistors (the fifth to seventh transistors) which are all N-type transistors or P-type transistors, so that the first terminal of the first capacitor is at a preset third bias voltage in response to the gate-off voltage on the first control signal line.

In another example, the reverse bias sub-circuit 11 may not comprise the sixth transistor and the seventh transistor, and instead, the above function may also be realized by connecting the gate electrode of the fifth transistor to the first node. Compared with a circuit structure including not only N-type transistors but also P-type transistors, the reverse bias sub-circuit is realized by five transistors (first to fifth transistors) which are all N-type transistors or P-type transistors, which can simplify the production process.

The current control sub-circuit 12 is coupled to the second terminal of the first capacitor, the first terminal of the organic light emitting diode, and the light emitting control sub-circuit 15 respectively, and is configured to control current flowing through the organic light emitting diode. As shown in FIG. 3, the current control sub-circuit 12 in the present embodiment may comprise a driving transistor Td having a gate electrode coupled to the second terminal of the first capacitor, a source electrode coupled to the light emitting control sub-circuit 15 and a drain electrode coupled to the first terminal of the organic light emitting diode. Thus, the driving transistor may adjust source-drain current under the control of the voltage of the gate electrode, thereby controlling the current flowing through the organic light emitting diode.

The data writing sub-circuit 13 is coupled to the second control signal S2, the data line and the gate electrode, the first electrode and the second electrode of the driving transistor respectively, and is configured to turn on a connection between the gate electrode and the source electrode of the driving transistor and turn on a connection between the data line and the drain electrode of the driving transistor under the control of the second control signal. As shown in FIG. 3, the data writing sub-circuit 13 comprises an eighth transistor and a ninth transistor. The eighth transistor has a gate electrode coupled to the second control signal line, a first electrode coupled to the data line, and a second electrode coupled to the drain electrode of the driving transistor. The ninth transistor has a gate electrode coupled to the second control signal line, a first electrode coupled to the gate electrode of the driving transistor, and a second electrode coupled to the source electrode of the driving transistor. Thus, the eighth transistor and the ninth transistor are turned on when the second control signal is the gate-on voltage, so that the connection between the gate electrode and the source electrode of the driving transistor is turned on and the connection between the data line and the drain electrode of the driving transistor is turned on. Thereby, the connection between the gate electrode and the source electrode of the driving transistor is turned on and the connection between the data line and the drain electrode of the driving transistor is turned on under the control of the second control signal.

The initialization sub-circuit 14 is coupled to a third control signal line for providing a third control signal S3, the first control signal line, and the first terminal and the second terminal of the first capacitor respectively, and is configured to set the second terminal of the first capacitor to be at a first initialization voltage under the control of the third control signal, and set the first terminal of the first capacitor to be at a second initialization voltage under the control of the signal on the first control signal line. As shown in FIG. 3, the initialization sub-circuit 14 may comprise a tenth transistor and an eleventh transistor, wherein the tenth transistor has a gate electrode coupled to the first control signal line, a first electrode coupled to a first reference voltage line for providing the first initialization voltage, and a second electrode coupled to the first terminal of the first capacitor. The eleventh transistor has a gate electrode coupled to the third control signal line, a first electrode coupled to a second reference voltage line for providing the second initialization voltage or the first bias voltage line for providing the first bias voltage, and a second electrode coupled to the second terminal of the first capacitor. In the present embodiment, the second initialization voltage may be a high-level voltage provided by the first bias voltage line. Hereinafter, how to set the first initialization voltage and the second initialization voltage will be specifically described in conjunction with an operation principle of the entire pixel compensation circuit. Thus, the tenth transistor is turned on when the first control signal is the gate-on voltage, and the first terminal of the first capacitor is set to be at the first initialization voltage provided by the first reference voltage line. The eleventh transistor is turned on when the third control signal is the gate-on voltage, and the second terminal of the first capacitor is set to be at a high-level voltage provided by the first bias voltage line. Thereby, the initialization sub-circuit 14 sets the second terminal of the first capacitor to be at the first initialization voltage under the control of the third control signal, and sets the first terminal of the first capacitor to be at the second initialization voltage under the control of the first control signal.

The light emitting control sub-circuit 15 is coupled to a fourth control signal line for providing a fourth control signal S4 and the source of the driving transistor respectively, and is configured to transfer the first bias voltage to the source of the driving transistor under the control of the fourth control signal. As shown in FIG. 3, the light emitting control sub-circuit 15 according to the present embodiment may comprise a twelfth transistor having a gate electrode coupled to the fourth control signal line, a first electrode coupled to the first bias voltage line for providing the first bias voltage, and a second electrode coupled to the source electrode of the driving transistor. Thus, the twelfth transistor is turned on in response to the gate-on voltage on the fourth control signal line, so that the first bias voltage is transferred to the source electrode of the driving transistor. Thereby, the first bias voltage is transferred by the light emitting control sub-circuit 15 to the source electrode of the driving transistor under the control of the fourth control signal.

Figure 4:
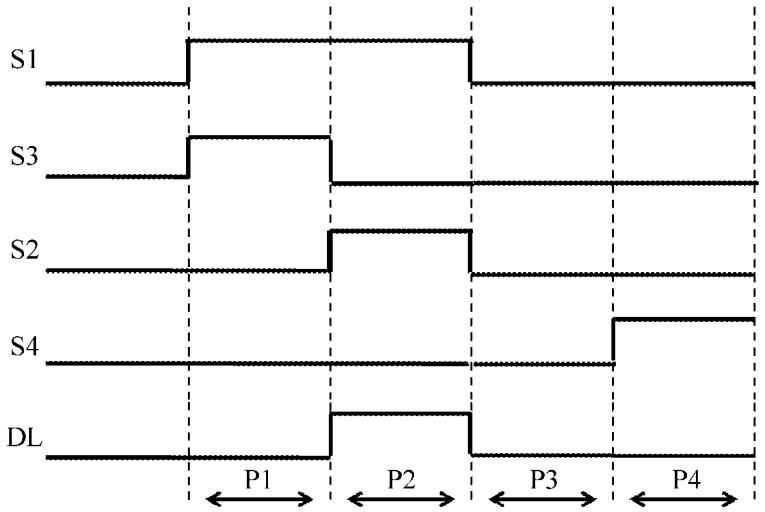
FIG. 4 is a circuit timing diagram of a pixel compensation circuit according to an embodiment of the present application.

FIG. 4 is a circuit timing diagram of the pixel compensation circuit shown in FIG. 3. As shown in FIG. 4, each operation period of the pixel compensation circuit sequentially comprises a capacitance resetting phase P1, a data writing phase P2, a voltage holding phase P3, and a compensation light emitting phase P4. FIGS. 5, 6, 7, and 8 are schematic diagrams of operation principles of the pixel compensation circuit in these four phases, respectively.

Figure 5:
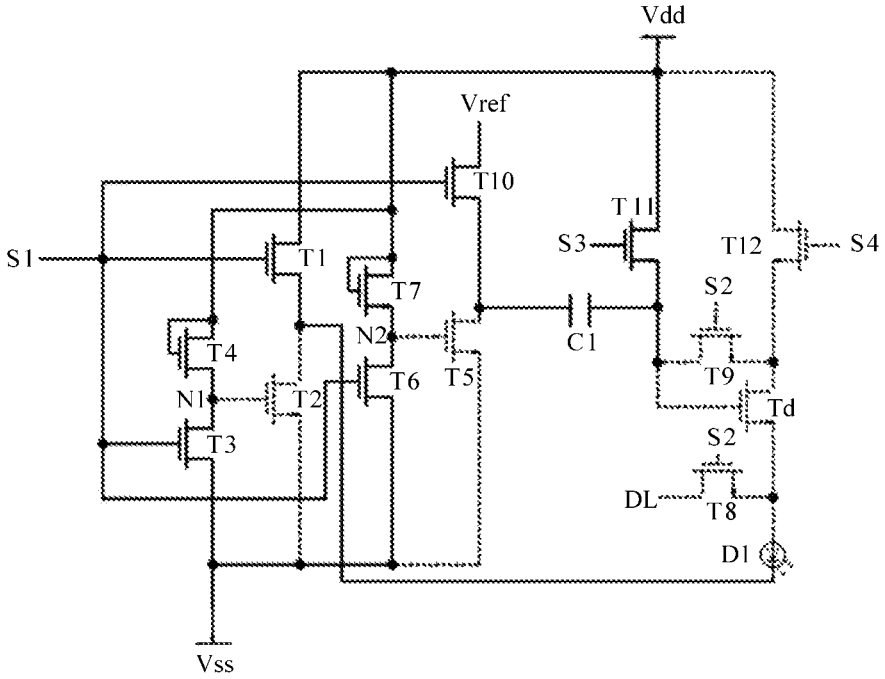
FIG. 5 is a schematic diagram of an operation principle of a pixel compensation circuit in a capacitance resetting phase according to an embodiment of the present application.

As shown in FIGS. 4 and 5, in the capacitance resetting phase P1, the first control signal S1 and the third control signal S3 are the gate-on voltage, and the second control signal S2 and the fourth control signal S4 are the gate-off voltage. The first transistor, the fourth transistor, the third transistor, the sixth transistor, the seventh transistor, the tenth transistor, and the eleventh transistor indicated by solid lines in FIG. 5 are all turned on, and the second transistor, the fifth transistor, the eighth transistor, the ninth transistor, and the twelfth transistor indicated by dashed lines are all turned off. Thus, on the one hand, the second terminal of the light emitting element is set to be at the first bias voltage, so that the light emitting element is maintained in the reverse bias state, and on the other hand, the first terminal of the first capacitor is set to be at the first initialization voltage Vref provided by the first reference voltage line, and the second terminal of the first capacitor is set to be at a high-level voltage provided by the first bias voltage line as the second initialization voltage. In this phase, although the gate electrode of the driving transistor is at the gate-on voltage, a current path is blocked by the twelfth transistor so that source-drain current cannot be formed, and therefore is indicated by the dashed lines in FIG. 5.

Figure 6:
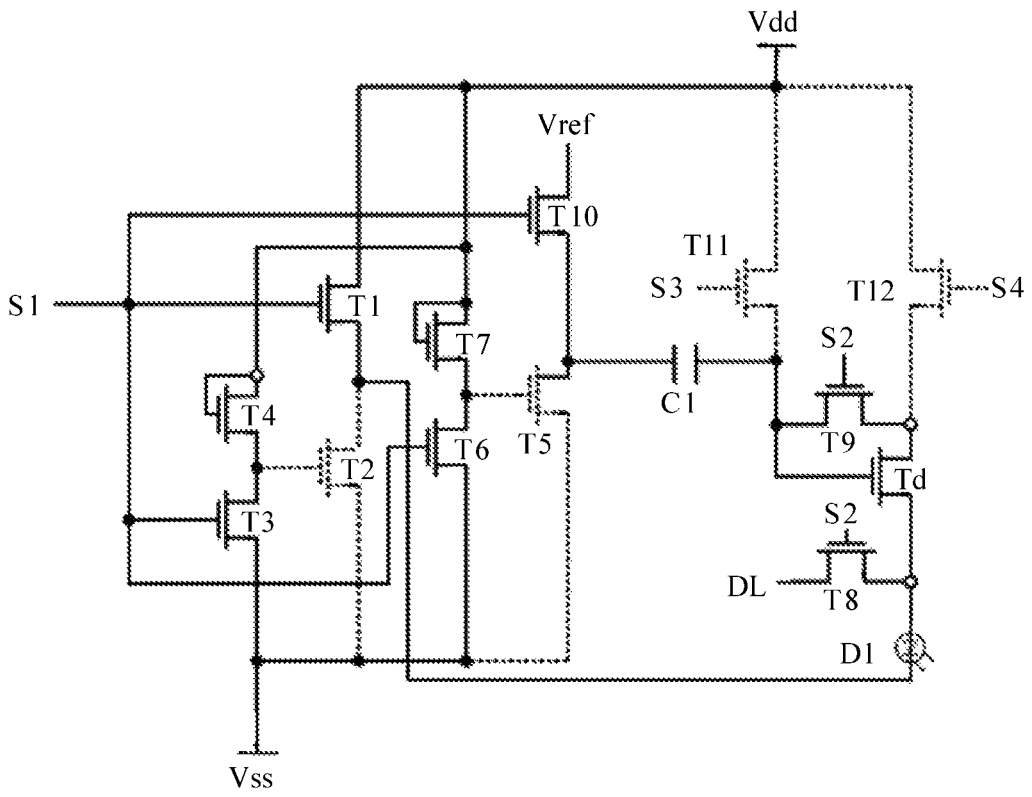
FIG. 6 is a schematic diagram of an operation principle of a pixel compensation circuit in a data writing phase according to an embodiment of the present application.

As shown in FIGS. 4 and 6, in the data writing phase P2, the first control signal S1 and the second control signal S2 are the gate-on voltage, the third control signal S3 and the fourth control signal S4 are the gate-off voltage, and the data voltage Vdata is provided on the data line. Thus, the first transistor, the fourth transistor, the third transistor, the sixth transistor, the seventh transistor, the tenth transistor, the eighth transistor, the ninth transistor, and the driving transistor indicated by the solid lines in FIG. 5 are all turned on, and the second transistor, the fifth transistor, the eleventh transistor, and the twelfth transistor indicated by the dashed lines are all turned off. Thus, the second terminal of the light emitting element is still set to be at the first bias voltage so that the light emitting element is maintained in the reverse bias state, and the first terminal of the first capacitor is maintained to be at the first initialization voltage Vref. Further, the eighth transistor, the ninth transistor, and the driving transistor are all turned on, and the data voltage Vdata is provided on the data line, so that the current flowing from the second terminal of the first capacitor to the data line is formed. Therefore, a potential at the second terminal of the first capacitor gradually decreases until the driving transistor is just turned off, and thus the voltage at the second terminal of the first capacitor after the driving transistor is just turned off is equal to Vdata+Vth, where Vth is the threshold voltage of the driving transistor.

Figure 7:
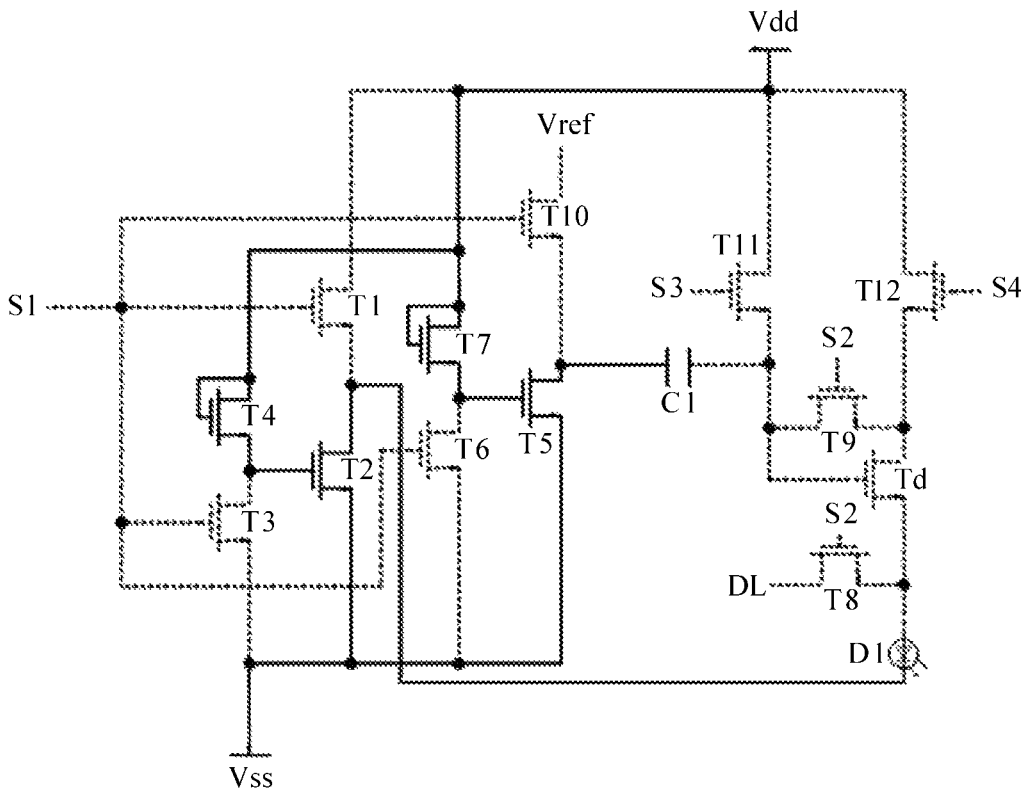
FIG. 7 is a schematic diagram of an operation principle of a pixel compensation circuit in a voltage holding phase according to an embodiment of the present application.

As shown in FIGS. 4 and 7, in the voltage holding phase P3, all the first control signal S1, the second control signal S2, the third control signal Se, and the fourth control signal S4 are the gate-off voltage, and thus the first transistor, the third transistor, the sixth transistor, the eighth transistor, the ninth transistor, the tenth transistor, the eleventh transistor, and the twelfth transistor which are indicated by dashed lines are all turned off, and the fourth transistor and the seventh transistor are turned on under the control of the gate-on voltage on the first bias voltage line, so that the second transistor and the fifth transistor are also turned on. Thereby, the second terminal of the light emitting element is converted from the first bias voltage to the second bias voltage, and the first terminal of the first capacitor jumps from the first initialization voltage Vref to the second bias voltage Vs. Due to charge retention of the first capacitor, the potential at the second terminal of the first capacitor also jumps therewith with the same amplitude, that is, jumps to Vdata+Vth−Vref+Vs. In addition, although the gate electrode of the driving transistor is at the gate-on voltage in this phase, the current path is blocked by the twelfth transistor so that the source-drain current cannot be formed, and therefore the driving transistor is also indicated by the dashed lines in FIG. 5. Further, the second terminal of the light emitting element has been set to be at the second bias voltage, but the light emitting element still does not emit light because no steady current has yet passed therethrough.

Figure 8:
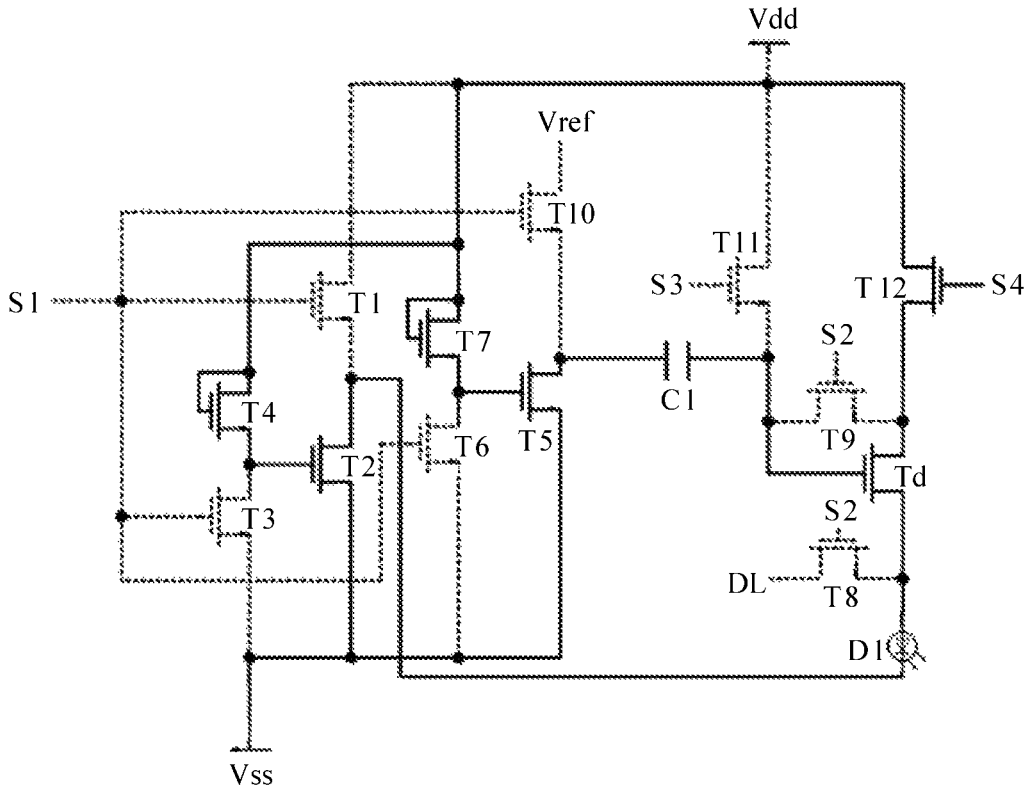
FIG. 8 is a schematic diagram of an operation principle of a pixel compensation circuit in a compensation light emitting phase according to an embodiment of the present application.

As shown in FIGS. 4 and 8, in the compensation light emitting phase P4, the first control signal S1, the second control signal S2, and the third control signal S3 are the gate-off voltage, and the fourth control signal S4 is the gate-on voltage. Thus, the twelfth transistor is changed from a turn-off state to a turn-on state, so that current may be formed between the first electrode and the second electrode of the driving transistor to drive the light emitting element to emit light. The current Ids may be expressed as:

$$Ids=K(V\text{data}+V\text{th}-V\text{ref}+Vs-Vs-V\text{th})^2=K(V\text{data}-V\text{ref})^2$$

where K is a parameter related to the driving transistor, which may be regarded as a constant here. It can be seen that Ids, which determines light emission brightness of the light emitting element, is not related to Vth, that is, the pixel compensation circuit according to the present embodiment achieves internal compensation of the threshold voltage.

At the same time, the first initialization voltage influences a numerical correspondence relationship between the data voltage and the driving current (light emission brightness), and therefore may be set according to application requirements. The third bias voltage corresponds to "+Vs" in the above equation, and a difference between the third bias voltage and Vs also influences the numerical correspondence relationship between the data voltage and the driving current (light emission brightness), and therefore may be set according to practical requirements. Of course, the third bias voltage may be set to be equal to the second bias voltage, which enables "+Vs" and "−Vs" in the above equation to cancel each other. Thereby, a number of signal lines to which the pixel compensation circuit needs to be coupled is reduced, and parameters which influence the light emission brightness can be reduced, which makes it easier to control the light emission brightness. In addition, the second initialization voltage is mainly used for detection of Vth, and the second initialization voltage may be set so that "the current flowing from the second terminal of the first capacitor to the data line is formed so that the potential at the second terminal of the first capacitor gradually decreases until the driving transistor is just turned off." Therefore, the second initialization voltage may be set to any value greater than a sum of a maximum value of the data voltage and the threshold voltage of the driving transistor. In addition, the second initialization voltage may be set as the first bias voltage, which can reduce the number of signal lines to which the pixel compensation circuit needs to be coupled, and further facilitate the simplification of the circuit structure.

A difference between the second initialization voltage and the maximum value of the data voltage in the present embodiment determines an available numerical compensation range of the threshold voltage. The numerical range is not influenced by prevention of the light emitting element from emitting light outside the compensation light emitting phase P4. Therefore, a larger compensation range of the threshold voltage can be realized and the display uniformity can be improved. When some or all of the transistors are replaced with P-type transistors, the operation principle of the pixel compensation circuit does not substantially change, so that a larger compensation range of the threshold voltage can also be achieved and the display uniformity can be improved.

In addition, compared with the pixel compensation circuit shown in FIG. 2, the pixel compensation circuit shown in FIG. 3 can separate a process of writing a data voltage (data writing phase P2) from a process of controlling a light emitting element to emit light (compensation light emitting phase P4), and therefore can avoid the problem that the stability of the data voltage is influenced by factors such as capacitive coupling etc., which in turns influences the light emission brightness, and facilitates improving the display effect.

In addition, as the pixel compensation circuit shown in FIG. 3 causes the data line to be coupled to the second electrode of the driving transistor through the first electrode and the second electrode of the transistor, which compared with, for example, the manner of writing the data voltage into the gate electrode coupled to the driving transistor shown in FIG. 2, causes the data voltage to be more directly applied to the first terminal of the light emitting element. Therefore, the voltage at the first terminal of the light emitting element does not exceed an allowable range due to the charging of the driving current, thereby allowing a larger input voltage range of the data voltage. In addition, as a gate electrode metal layer having a large area coupled to the driving transistor is avoided, the adverse effect on the circuit due to the coupling capacitance at the gate electrode metal layer can be reduced, and the stability of the pixel compensation circuit can be improved.

Based on the same concept, another embodiment of the present application further provides a method for driving the pixel compensation circuit described above, which comprises:

maintaining the light emitting element by the reverse bias sub-circuit in a reverse bias state under the control of the first control signal in a time period of each display period other than a time period in which the current control sub-circuit controls the light emitting element to emit light.

For example, in the above example of the pixel compensation circuit, "the time period other than a time period in which the light emitting element emits light" may be, for example, the capacitance resetting phase P1 and the data writing phase P2, and depending on a form of the pixel compensation circuit used, a manner of setting the time period may not be limited thereto.

In addition, for the pixel compensation circuit including the reverse bias sub-circuit, the current control sub-circuit, the data writing sub-circuit, the initialization sub-circuit, the light emitting control sub-circuit, and the first capacitor, the step of maintaining, by the reverse bias sub-circuit, the light emitting element in a reverse bias state under the control of the first control signal in a time period of each display period other than a time period in which the light emitting element emits light may comprise:

in a first phase of each display period, setting, by the reverse bias sub-circuit, the second terminal of the light emitting element to be at the preset first bias voltage under the control of the first control signal, so that the light emitting element is maintained in a reverse bias state, and setting, by the initialization sub-circuit, the second terminal of the first capacitor to be at the first initialization voltage under the control of the third control signal, and setting the first terminal of the first capacitor to be at the second initialization voltage under the control of the first control signal; and in a second phase of each display period, setting, by the reverse bias sub-circuit, the second terminal of the light emitting element to be at the preset first bias voltage under the control of the first control signal, so that the light emitting element is maintained in a reverse bias state, and turning on, by the data writing sub-circuit, a connection between the gate electrode and the source electrode of the driving transistor and a connection between the data line and the drain electrode of the driving transistor under the control of the second control signal.

In addition, the method may further comprise:

in a third phase of the display period, setting, by the reverse bias sub-circuit, the first terminal of the first capacitor to be at the preset third bias voltage under the control of the first control signal which is the gate-off voltage; and in a fourth phase of the display period, transferring, by the light emitting control sub-circuit, the first bias voltage to the source electrode of the driving transistor under the control of the fourth control signal.

In an example, the above driving method may be the signal timings of the first control signal, the second control signal, the third control signal, and the fourth control signal represented in FIG. 4, and the corresponding operation flows of the circuit are as described above, and will not be repeated here.

The method according to the embodiment of the present application can be applied to the pixel compensation circuit described above to achieve compensation of the threshold voltage, and does not limit the available compensation range of the threshold voltage. Therefore, the method according to the embodiment of the present application can achieve a larger compensation range of the threshold voltage, and facilitate improving the display uniformity.

Based on the same concept, still another embodiment of the present application further provides a display apparatus including the pixel compensation circuit according to the embodiment of the present application. The display apparatus according to the embodiment of the present application may be any product or component having a display function such as a mobile phone, a tablet computer, a television, a display, a notebook computer, a digital photo frame, a navigator, etc. Based on the features of the pixel compensation circuit such as a wider compensation range of the threshold voltage, the display apparatus according to the embodiment of the present application may easily achieve better display uniformity.

The above description is only the preferred embodiments of the present application and is not intended to limit the present application. Any modification, equivalent replacement, improvement etc. made within the spirit and principle of the present application shall fall within the protection scope of the present application.

We claim:

1. A pixel compensation circuit, comprising:

a light emitting element;

a current control sub-circuit electrically coupled to a first terminal of the light emitting element and configured to control magnitude of current flowing through the light emitting element; and a reverse bias sub-circuit electrically coupled to a first control signal line for providing a first control signal and a second terminal of the light emitting element respectively;

wherein the reverse bias sub-circuit is configured to set the second terminal of the light emitting element to be at a first bias voltage under control of the first control signal, so that the light emitting element is maintained in a reverse bias state;

wherein the reverse bias sub-circuit comprises a first transistor, a second transistor, a third transistor and a fourth transistor, wherein:

the first transistor has a gate electrode electrically coupled to the first control signal line, a first electrode electrically coupled to a first bias voltage line for providing the first bias voltage, and a second electrode electrically coupled to the second terminal of the light emitting device;

the second transistor has a gate electrode electrically coupled to a first node, a first electrode electrically coupled to the second terminal of the light emitting device, and a second electrode electrically coupled to a second bias voltage line for providing a second bias voltage, wherein the first bias voltage and the second bias voltage are respective ones of a gate-on voltage and a gate-off voltage;

the third transistor has a gate electrode electrically coupled to the first control signal line, a first electrode electrically coupled to the first node, and a second electrode electrically coupled to one of the first bias voltage line and the second bias voltage line which provides the gate-off voltage; and the fourth transistor has a gate electrode and a first electrode electrically coupled to one of the first bias voltage line and the second bias voltage line which provides the gate-on voltage, and a second electrode electrically coupled to the first node;

wherein the third transistor and the fourth transistor are configured to set the first node to be at the gate-off voltage when the first control signal is the gate-on voltage.

2. The pixel compensation circuit according to claim 1, further comprising a first capacitor, wherein the reverse bias sub-circuit is further electrically coupled to a first terminal of the first capacitor, and is further configured to set the first terminal of the first capacitor to be at a third bias voltage when the first control signal is the gate-off voltage.

3. The pixel compensation circuit according to claim 2, wherein the current control sub-circuit comprises a driving transistor having a gate electrode coupled to a second terminal of the first capacitor; and the pixel compensation circuit further comprises a data writing sub-circuit electrically coupled to a second control signal line for providing a second control signal, a data line and the driving transistor, and configured to turn on a connection between the gate electrode and a source electrode of the driving transistor and a connection between the data line and a drain electrode of the driving transistor under control of the second control signal.

4. The pixel compensation circuit according to claim 3, further comprising an initialization sub-circuit electrically coupled to a third control signal line for providing a third control signal, the first control signal line and the first terminal and the second terminal of the first capacitor, and configured to set the second terminal of the first capacitor to be at a first initialization voltage under control of the third control signal, and set the first terminal of the first capacitor to be at a second initialization voltage under control of the first control signal.

5. The pixel compensation circuit according to claim 4, further comprising a light emitting control sub-circuit coupled to a fourth control signal line for providing a fourth control signal and the source electrode of the driving transistor respectively, and configured to transfer the first bias voltage to the source electrode of the driving transistor under control of the fourth control signal.

6. The pixel compensation circuit according to claim 5, wherein the data writing sub-circuit comprises an eighth transistor and a ninth transistor, the initialization sub-circuit comprises a tenth transistor and an eleventh transistor, and the light emitting control sub-circuit comprises a twelfth transistor; wherein:

in the data writing sub-circuit, the eighth transistor has a gate electrode electrically coupled to the second control signal line, a first electrode electrically coupled to the data line, and a second electrode electrically coupled to the drain electrode of the driving transistor, and the nine transistor has a gate electrode electrically coupled to the second control signal line, a first electrode coupled to the gate electrode of the driving transistor, and a second electrode electrically coupled to the drain electrode of the driving transistor;

in the initialization sub-circuit, the tenth transistor has a gate electrode electrically coupled to the first control signal line, a first electrode electrically coupled to a first reference voltage line for providing the first initialization voltage, and a second electrode electrically coupled to the first terminal of the first capacitor, and the eleventh transistor has a gate electrode electrically coupled to the third control signal line, a first electrode electrically coupled to a second reference voltage line for providing the second initialization voltage or a first bias voltage line for providing the first bias voltage, and a second electrode electrically coupled to the second terminal of the first capacitor; and in the light emitting control sub-circuit, the twelfth transistor has a gate electrode electrically coupled to the fourth control signal line, a first electrode electrically coupled to the first bias voltage line for providing the first bias voltage, and a second electrode electrically coupled to the drain electrode of the driving transistor.

7. The pixel compensation circuit according to claim 2, wherein the reverse bias sub-circuit further comprises a fifth transistor having a gate electrode electrically coupled to the first node, a first electrode electrically coupled to the first terminal of the first capacitor, and a second electrode electrically coupled to the second bias voltage line.

8. The pixel compensation circuit according to claim 2, wherein the reverse bias sub-circuit further comprises a fifth transistor, a sixth transistor, and a seventh transistor; wherein:

the fifth transistor has a gate electrode electrically coupled to a second node, a first electrode electrically coupled to the first terminal of the first capacitor, and a second electrode electrically coupled to the second bias voltage line;

the sixth transistor has a gate electrode electrically coupled to the first control signal line, a first electrode electrically coupled to the second node, and a second electrode electrically coupled to one of the first bias voltage line and the second bias voltage line which provides the gate-off voltage; and the seventh transistor has a gate electrode and a first electrode electrically coupled to one of the first bias voltage line and the second bias voltage line which provides the gate-on voltage, and a second electrode electrically coupled to the second node;

wherein the sixth transistor and the seventh transistor are configured to enable the second node to be set at the gate-off voltage when the first control signal is the gate-on voltage.

9. A method for driving the pixel compensation circuit according to claim 1, comprising:

maintaining, by the reverse bias sub-circuit, the light emitting element in a reverse bias state under control of the first control signal in a time period of each display period other than a time period in which the light emitting element emits light.

10. A display apparatus, comprising:

a plurality of data lines;

a first control signal line;

a plurality of second control signal lines;

a third control signal line;

a fourth control signal line;

a first bias voltage line;

a second bias voltage line; and a plurality of pixel units provided at crossings between various data lines and various second control signal lines, wherein at least one of the plurality of pixel units comprises the pixel compensation circuit according to claim 1.

* * * * *